United States Patent [19]

Edwards

[11] 4,265,041

[45] May 5, 1981

[54] INDICIA-SUPPORTING CLIP

[75] Inventor: Lindell N. Edwards, St. Louis, Mo.

[73] Assignee: Commander Board International, Inc., St. Louis, Mo.

[21] Appl. No.: 143,749

[22] Filed: Apr. 25, 1980

[51] Int. Cl.[3] ..... G09F 7/20

[52] U.S. Cl. ..... 40/620

[58] Field of Search ..... 40/11 R, 10 R, 607, 40/620, 11 A, 619, 618

[56] References Cited

U.S. PATENT DOCUMENTS

| | | | |
|---|---|---|---|
| 947,377 | 1/1910 | De Puy | 40/620 |
| 2,155,904 | 4/1939 | Lowinger | 40/618 |
| 3,173,220 | 3/1965 | Lachenmeir | 40/618 |
| 3,225,477 | 12/1965 | Edwards | 40/620 |
| 3,532,317 | 10/1970 | Adler | 40/618 |

*Primary Examiner*—Gene Mancene
*Assistant Examiner*—Wenceslao J. Contrera
*Attorney, Agent, or Firm*—Rogers, Eilers & Howell

[57] ABSTRACT

An indicia-supporting clip has a plurality of fingers which directly engage and hold an edge of an indicia, and has a board-indicating portion which engages and is held by a signboard to releasably hold that indicia in engagement with that signboard.

17 Claims, 6 Drawing Figures

INDICIA-SUPPORTING CLIP

BACKGROUND OF THE INVENTION

1. Field of the Invention

Indicia for signboards are more prominent and are more readily recognized when they are displaced forwardly of, than when they lie in the plane of, a signboard. Indicia for a signboard should be capable of being shipped and stored while "nested," and yet should be capable of being displaced forwardly of that signboard.

2. Description of the Prior Art

L. N. Edwards U.S. Pat. No. 3,225,477 discloses a clip which disposes indicia forwardly of a signboard; and that clip is completely invisible when the indicia are viewed from a position directly in front of the signboard. However, that clip requires the rear surface of each indicia to be equipped with a socket.

Other indicia, which can be displaced forwardly of signboards, have clip-receiving devices at the rear thereof. Still other indicia, which can be displaced forwardly of signboards, have board-engaging members incorporated therein or affixed thereto.

SUMMARY OF THE INVENTION

A resilient clip has a plurality of relatively-movable fingers at one end thereof which can apply pressure to one edge of an indicia to grip that indicia. The other end of that clip has a board-engaging portion which can engage a signboard. That clip has spacing portions intermediate the ends thereof which can space the end with the plurality of fingers forwardly of the board-engaging portion at the other end, and hence can enable that clip to space an indicia forwardly of a signboard. It is, therefore, an object of the present invention to provide a clip which has a plurality of relatively-movable fingers at one end thereof which can apply pressure to one edge of an indicia, which has the other end thereof adapted to engage a signboard, and which has spacing portions intermediate those ends to space that indicia forwardly of that signboard.

Other and further objects and advantages of the present invention should become apparent from an examination of the drawing and accompanying description.

In the drawing and accompanying description a preferred embodiment of the present invention is shown and described but it is to be understood that the drawing and accompanying description are for the purpose of illustration only and do not limit the invention and that the invention will be defined by the appended claims.

DETAILED DESCRIPTION OF PREFERRED EMBODIMENT

Figure 1:
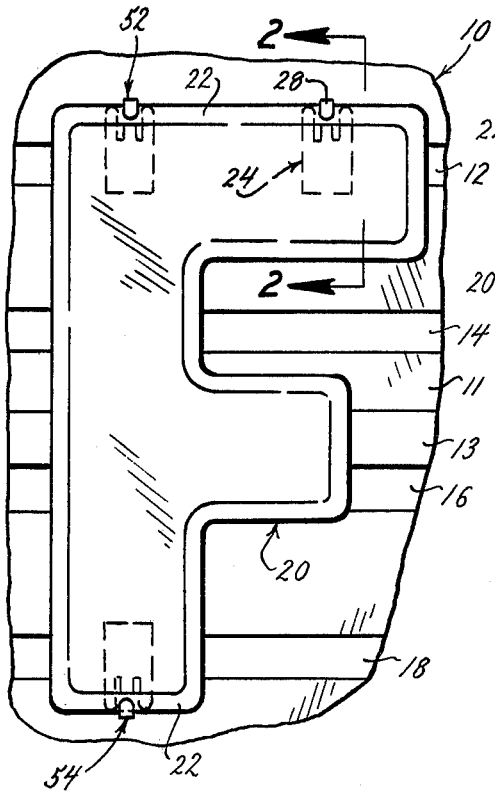
FIG. 1 is a front elevational view of a portion of a signboard, of an indicia which is disposed forwardly of that signboard, and of portions of three clips which engage that signboard and that indicia to hold that indicia spaced forwardly of that signboard.

Referring to the drawing in detail, the numeral 10 generally denotes a signboard with which the clips provided by the present invention can be used. That signboard is intended to be held in a vertical position; and it has a number of horizontally-directed grooves 12, 14, 16 and 18 therein which are trapezoidal in cross section. That signboard can, and preferably will, be identical to the signboard in L. N. Edwards U.S. Pat. No. 3,289,340 for Display Signs, which was granted on Dec. 6, 1968.

The signboard 10 has a number of sections; and one of those sections is denoted by the numeral 11 while the next-lower section is denoted by the numeral 13. The grooves 12 and 14 are in the section 11, and the grooves 16 and 18 are in the section 13. Interlocking surfaces, not shown, which preferably are identical to the interlocking surfaces shown in U.S. Pat. No. 3,289,340, are provided at the confronting edges of the sections 11 and 13. Those interlocking surfaces will coact to maintain those confronting edges in precisely-aligned mating engagement.

The numeral 20 generally denotes an indicia which has the form of the letter "F." That indicia is essentially planar, but it has a rearwardly-bent peripheral flange 22. As indicated particularly by FIG. 2, that flange inclines outwardly and rearwardly from the plane of the front of indicia 20 at an angle of about forty-five degrees. That indicia preferably is made from aluminum; because aluminum is light in weight and is readily cut and formed. However, if desired, the indicia 20 could be made from other metals or could be made from stiff non-metallic materials.

The indicia 20 preferably is coated with paint to make it attractive in appearance and easy to detect when it is mounted in front of, and adjacent to, the signboard 10. If desired, light reflecting beads could be incorporated into the coating for that indicia. The indicia 20 is shown as being the letter "F;" but it could constitute any of the letters of the alphabet, could constitute any of the arabic numerals, could constitute any of the punctuation marks, or could constitute an indicia of any other desired form, size or configuration. A signboard usually will have a considerable number of indicia mounted in front of it to display a desired message to the public.

Figure 2:
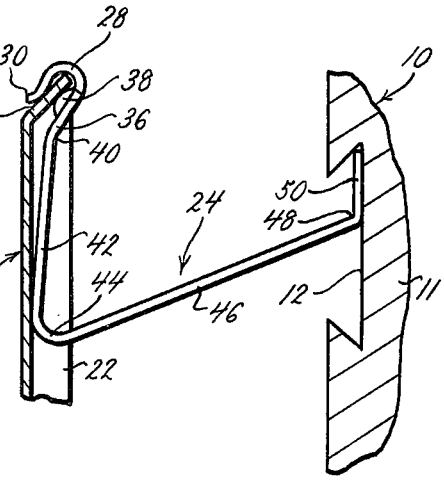
FIG. 2 is a sectional view, on a larger scale, of a part of the portion of the signboard shown in FIG. 1, of a part of the indicia shown in FIG. 1, and of one of the clips shown in FIG. 1.

The numeral 24 generally denotes a preferred embodiment of clip which is made in accordance with the principles and teachings of the present invention. That clip has three relatively-movable fingers 26, 32 and 36 at one end thereof. The finger 26 has a generally U-shaped confining portion 28 at the outer end thereof; and that confining portion has an outwardly-bent free end 30, as shown particularly by FIGS. 2–4. That generally U-shaped confining portion is dimensioned to define a U-shaped recess which has a width that is smaller than the thickness of the flange 22 of indicia 20. However, that generally U-shaped confining portion is sufficiently resilient to permit the confronting faces thereof to be spread far enough apart to permit that flange to be pushed into position between those faces, as indicated by FIG. 2. As the confronting faces of that generally U-shaped confining portion are spread apart, restorative forces will be developed in that generally U-shaped confining portion which will cause those confronting faces to apply appreciable gripping forces to the front and rear surfaces of flange 22 of indicia 20. The outwardly-bent free end 30 of the generally U-shaped confining portion 28 facilitates the telescoping of that confining portion over the rear edge of the flange 22. A bend 31 is provided in the finger 26; and that bend is a gentle, rather than an abrupt, bend. That bend enables the rear surface of finger 26 to subtend an angle of about one hundred and forty-two (142) degrees.

Figure 3:
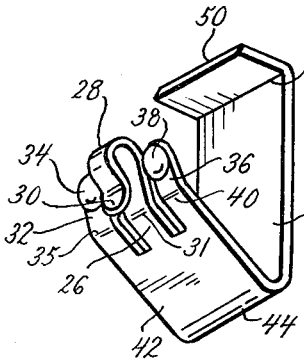
FIG. 3 is a perspective view, on a scale intermediate those of FIGS. 1 and 2, of the clip of FIG. 2.
Figure 4:
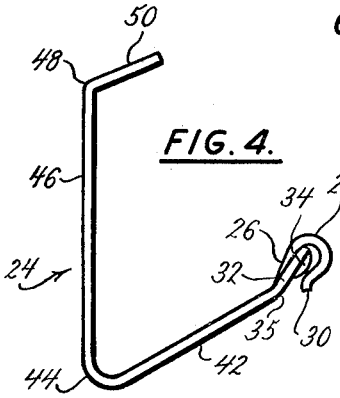
FIG. 4 is a side elevational view, on a scale intermediate those of FIGS. 2 and 3, of the clip of FIG. 2.
Figure 5:
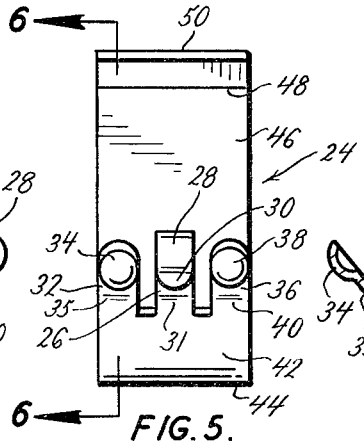
FIG. 5 is a front elevational view, on the scale of FIG. 4, of the clip of FIG. 2.
Figure 6:
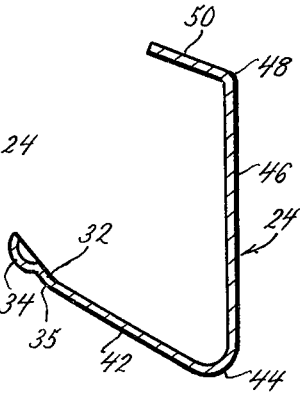
FIG. 6 is a sectional view, on the scale of FIG. 4, which is taken along the plane indicated by the line 6—6 in FIG. 5.

The finger 32 is disposed to the left of the finger 26, as those fingers are viewed in FIGS. 3 and 5. The finger 32 is shorter than the finger 26; and it does not have a generally U-shaped confining portion at the free end thereof. Instead, the finger 32 has a forwardly-bent abutment 34 adjacent the free end thereof. In the preferred embodiment of the present invention, that abutment is generally spherical in configuration, as indicated particularly by FIGS. 5 and 6.

A bend 35 is provided in the finger 32; and that bend is a gentle, rather than an abrupt, bend. That bend is in register with the bend 31 of finger 26, as indicated by FIGS. 3 and 5. The bend 35 enables the rear surface of finger 32 to subtend an angle of about one hundred and forty-seven (147) degrees. As indicated particularly by FIG. 4, the convex outer face of the forwardly-bent abutment 34 is in register with the space which is defined by the generally U-shaped confining portion 28 at the outer end of the finger 26. Further, that convex outer face is very close to a plane which is defined by the inner surface of the outwardly-bent free end 30 of that generally U-shaped confining portion. As a result, either the finger 32 must be bent to the left in FIG. 4, the finger 26 must be bent to the right, or the finger 32 must be bent to the left and the finger 26 must be bent to the right to permit the flange 22 of the indicia 20 to move the abutment 34 out of its way so the free edge of that flange can be forced into, and be held by, the generally U-shaped confining portion 28. The bending of the finger 26, the bending of the finger 32 or the bending of both fingers 26 and 32 will develop restorative forces within one or both of those fingers which will cause the abutment 34 and the adjacent part of the generally U-shaped confining portion 28 to apply appreciable friction-type gripping forces to the front and rear surfaces of the flange 22. Those gripping forces will enable the clip 24 to grip the flange 22 tightly.

The finger 36 is disposed to the right of the finger 26 as those fingers are viewed in FIGS. 3 and 5. The finger 36 preferably is identical to the finger 32—having a forwardly-bent abutment 38 which preferably is identical to the forwardly-bent abutment 34, and having a bend 40 which preferably is identical to the bend 35. As a result, the convex outer face of the forwardly-bent abutment 38 will be in register with the convex outer face of the forwardly-bent abutment 34 on the finger 32, whenever the clip 24 is in an unstressed condition. All of this means that the convex outer faces of the forwardly-bent abutments 34 and 38 define a cylindrical surface of arcuate cross-section which is very close to the inner surface of the outwardly-bent free end 30 of the generally U-shaped confining portion 28, as indicated particularly by FIG. 4. Consequently, both of the fingers 32 and 36 must be bent inwardly, the finger 26 must be bent outwardly, or the fingers 32 and 36 must be bent inwardly and the finger 26 must be bent outwardly to enable the edge of the flange 22 of indicia 20 to be forced past the abutments 34 and 38 to come to rest within the generally U-shaped confining portion 28.

The bending of the fingers 32 and 36, the bending of the finger 26, or the bending of all of fingers 26, 32 and 36 will develop restorative forces which will urge the forwardly-bent abutments 34 and 38 into intimate gripping engagement with the rear surface of flange 22 and also will urge the rear surface of the outwardly-bent free end 30 of the generally U-shaped confining portion 28 into intimate gripping engagement with the front surface of that flange. Those gripping engagements will tend to hold the clip 24 in engagement with the flange 22 of indicia 20 even though appreciable dislodging forces were applied to that clip or to that indicia. However, a firm and steady force can readily set the clip 24 in engagement with the flange 22, and a further firm and steady force can readily separate that clip from that flange.

The numeral 42 denotes a spacing portion of clip 24; and that spacing portion has the fingers 26, 32 and 36 at the outer end thereof. A bend 44 displaces a further spacing portion 46 from the spacing portion 42; and that bend is a gentle, rather than an abrupt, bend. That bend causes those spacing portions to subtend an angle of about fifty-seven (57) degrees whenever the clip 24 is in its un-stressed condition. A bend 48 is provided at the other end of the spacing portion 46, and that bend is abrupt. That bend displaces the board-engaging end 50 of the clip 24 from the spacing portion 46 by an angle of about one hundred and nine (109) degrees whenever that clip is in its un-stressed condition. The spacing portion 42 is about nine-sixteenths (9/16) of an inch long, each finger 32 and 36 is about five-sixteenths (5/16) of an inch long, the spacing portion 46 is about one (1) inch long, and the board-engaging portion 50 is about one-quarter ($\frac{1}{4}$) of an inch long. Each clip is about one-half ($\frac{1}{2}$) of an inch wide and is about eighteen-thousandths (0.018) of an inch thick. The clip 24 preferably is made from spring steel, so it will be sturdy and resilient. That clip will be suitably electroplated or otherwise coated to enable it to withstand rust or corrosion when it is used to hold indicia adjacent an outdoor signboard.

In using the clip 24, the bend 44 will be disposed adjacent the rear face of the indicia 20; and the outwardly-bent free end 30 of the generally U-shaped confining portion 28 of finger 26 and the forwardly-bent abutments 34 and 38 of fingers 32 and 36, respectively, will be disposed adjacent the outer edge of a portion of the flange 22. Thereafter, a force will be applied to the inner face of the bend 44, to the adjacent area of the spacing portion 46, or to the outer surface of the generally U-shaped confining portion 28 of finger 26 to cause that generally U-shaped confining portion to telescope over that outer edge of that flange. Ad indicated hereinbefore, the fingers 32 and 36 must bend inwardly, the finger 26 must bend outwardly, or fingers 32 and 36 must bend inwardly and finger 26 must bend outwardly to permit that edge of flange 22 to be forced past the abutments 34 and 38 to enter the generally U-shaped portion 28. In addition, the outwardly-bent free end 30 of that generally U-shaped confining portion must bow away from the confronting surface of the rear part of that generally U-shaped confining portion to permit the flange 22 to move into, and seat within, that generally U-shaped confining portion. The restorative forces within one or more of the fingers 26, 32 and 36 will coact with the restorative forces in the generally U-shaped confining portion 28 to enable the clip 24 to tightly grip the flange 22 of indicia 20.

At this time, the bends 31, 35 and 40, respectively, of the fingers 26, 32 and 36, will be displaced rearwardly from the rear face of the indicia 20, as indicated by FIG. 2. Also, the major portion of the length of the spacing portion 42 will be displaced rearwardly of the rear face of that indicia. However, the bend 44 will be urged into engagement with the rear face of that indicia by the restorative forces within the fingers 26, 32 and 36.

The numerals 52 and 54 denote further clips which preferably are identical to the clip 24. The clip 52 is shown as being assembled with the horizontally-directed top edge of the indicia 20 at a point which is spaced to the left of the clip 24. The clip 54 is shown as being assembled with the bottom edge of the vertically-directed portion of the indicia 20, all as indicated by FIG. 1.

The board-engaging ends 50 of clips 24 and 52 will be in register with each other, and the board-engaging end 50 of the clip 54 will be in vertical registry with the board-engaging end 50 of clip 52. A straight-line distance between the board-engaging end 5 of clip 52 and the board-engaging end 50 of clip 54 will be about five-eighths ($\frac{5}{8}$) of an inch longer than the straight-line distance between the apex of the dihedral angle which is defined by the lower portion of groove 18 and the upper outer edge of the groove 12. Further, the straight-line distance between the board-engaging ends 50 of clips 52 and 54 will be about seventeen thirty-seconds (17/32) of an inch longer than the distance between the apex of the dihedral angle which is defined by the lower portion of groove 18 and the apex of the dihedral angle which is formed by the upper portion of groove 12. Consequently, the bends 44 of the clips 24 and 52 must be stressed to enlarge the dihedral angles which are defined by the spacing portions 42 and 46 of those clips and, similarly, the bend 44 of the clip 54 must be stressed to enlarge the dihedral angle which is defined by the spacing portions 42 and 46 of that clip. The resulting bending of the board-engaging ends 50 of clips 24, 52 and 54 toward each other will enable those board-engaging ends to enter the grooves 12 and 18. The releasing of those stressing forces will enable the board-engaging ends of clips 24 and 52 to come to rest immediately adjacent the apex of the dihedral angle which is defined by the upper portion of the groove 12 and will enable the board-engaging end 50 of the clip 54 to come to rest immediately adjacent the apex of the dihedral angle which is defined by the lower portion of the groove 18.

For convenience, the installer of the indicia 20 will usually hold the upper end of that indicia outwardly away from the groove 12 while he or she inserts the board-engaging end 50 of the clip 52 in the groove 18 and then moves that board-engaging end downwardly until it is immediately adjacent the apex of the dihedral angle which is defined by the lower end of groove 18. Thereafter, the installer will use two or more fingers to apply downwardly-directed forces to the spacing portions 46 of the clips 24 and 52 to cause the board-engaging ends 50 of those clips to move downwardly below the level of the front upper edge of the groove 12. While holding those board-engaging ends below that level, the installer will move those board-engaging ends inwardly of that front upper edge and then release the downward forces on the spacing portions 46. At such time, the restorative forces within the bends 44 of the clips 24, 52 and 54 will force the board-engaging ends 50 of the clips 24 and 52 upwardly into position immediately adjacent the apex of the dihedral angle which is defined by the upper portion of the upper end of groove 12. Thereupon, the board-engaging ends of the clips 24, 52 and 54 will coact with the dihedral angles which are defined by the grooves 12 and 18 to solidly hold the indicia 20 in position adjacent, but disposed forwardly of, the signboard 10. Further, the restorative forces within the bends 44 of the various clips 24, 52 and 54 will provide such intimate engagements between the board-engaging ends 50 and the dihedral angles which are defined by the upper end of groove 12 and by the lower end of groove 18 that normal accidentally-applied forces will not dislodge any of those clips or the indicia 20 from their positions adjacent the signboard 10.

The stressing of the bends 44 of the clips 24, 52 and 54—to increase the dihedral angles which are defined by the spacing portions 42 and 46 of those clips, as those clips are bent to permit the board-engaging portions 50 thereof to be set within the dihedral angles which are defined by the upper portion of groove 12 and by the power portion of groove 18—will cause those bends to act as fulcrums and thereby cause the rear face of the forwardly-bent free end 30 of the finger 26 of each of those clips to try to move into even tighter engagement with the front of the flange 22 on the indicia 20. Also, the stressing of the bends 44 will cause the clips 24 and 52 to tend to move downwardly relative to indicia 20 while causing the clip 54 to tend to move upwardly relative to that indicia; and hence that stressing will urge each generally U-shaped confining portion 28 into intimate holding engagement with the adjacent edge of flange 22 of that indicia. Even after the finger-applied stress on the bends 44 of the clips 24, 52 and 54 is relaxed, to permit the board-engaging ends 50 of those clips to seat immediately adjacent the apices of the dihedral angles which are defined by the upper end of groove 12 and by the lower end of groove 18, the bends 44 of of those clips will still be stressed. That continuing stress will cause those bends to continue to act as fulcrums, and will thereby cause the rear faces of the forwardly-bend free ends 30 of the fingers 26 of those clips to provide an intimate gripping engagement with the forward surface of the flange 22.

It will be noted that the clips 24, 52 and 54 do not require the indicia 20 to have brackets or other securing means affixed thereto. As a result, the present invention obviates the cost of such brackets, and also obviates the cost of attaching those brackets to that indicia. Further, by obviating all need of any such brackets, the present invention obviates the problems of cleaning or coating areas of the front of the indicia which are darkened by heat during the spot welding of the brackets to the rear of the indicia.

The present invention makes the forming of the indicia 20 quite simple and efficient. Specifically, that indicia can be painted or otherwise coated with a desired coating material while it is a part of a large uninterrupted sheet. Thereafter, a thin protective covering of polyvinyl chloride or other tough, flexible plastic is applied to the coating on the front of the large uninterrupted sheet to protect that coating during the forming of that indicia, during storing of that indicia, and during shipping of that indicia. That large uninterrupted sheet, with its thin protective covering, can then be passed through a suitable indicia-forming machine, such as a punch press, to form the indicia 20 and the flange 22 thereon. That indicia plus similar indicia can be stacked together in a compact manner; because all indicia of the same kind will neatly "nest" together. This is possible because those indicia do not have securing brackets attached thereto. As the installer prepares to mount the indicia 20 on the signboard 10, the installer will strip away the thin protective covering and then affix the clips 24, 52 and 54 to appropriate portions of the flange 22. This means that the indicia 20 is fully protected by that thin protective covering up to the time that indicia is mounted on the signboard 10. Consequently, that indicia will be free from nicks, chips, cuts and scratches which otherwise could be formed on it during the storing, handling and shipping of that indicia.

The forward halves of the generally U-shaped confining portions 28 on the fingers 26 of the clips 24, 52 and 54 will overlie part of the front of the flange 22 of the indicia 20. However, the horizontal dimension of each of those generally U-shaped confining portions is less than one-eighth ($\frac{1}{8}$) of an inch, and the vertical dimension of each of those generally U-shaped confining portions is only about one-eighth ($\frac{1}{8}$) of an inch, whereas the straight-line distance between the rear edges of the flanges 22 at the ends of the horizontally-directed upper portion of indicia 20 is almost three and three-quarter inches ($3\frac{3}{4}$) and that flange is more than three-sixteenths (3/16) of an inch wide. Even the straight-line distance between the rear edges of the flanges 22 on the vertically-directed portion of the indicia 20 is one and one-half ($1\frac{1}{2}$) inches. Consequently, even if the full vertical dimension of the forward half of the generally U-shaped confining portion 28 of each of the clips 24, 52 and 54 overlay the flange 22, the percentage of the area of that flange which was covered by those forward halves would be negligible. Actually, because the generally U-shaped confining portions 28 of the clips 24, 52 and 54 have some thicknesses, the full lengths of the front halves of those generally U-shaped confining portions do not overlie the front faces of the flange 22. It should also be noted that because the generally U-shaped confining portions 28 of the clips 24, 52 and 54 engage the rearwardly-inclined flange 22 rather than a part of the planar front of the indicia 20, those generally U-shaped confining portions are less noticeable than they would be if they engaged part of that planar portion. The overall result is that the viewer of the signboard 10 and of the indicia therefor will rarely, if ever, consciously note the generally U-shaped confining portions 28 on the fingers 26 of the clips 24, 52 and 54.

The spacing portions 46 of the clips 24, 52 and 54 are useful in spacing the indicia 20 forwardly of the signboard 10. In addition, those spacing portions are useful in providing sufficient room between the front of that signboard and the rear of the indicia 20 to facilitate the movement of the installer's fingers into direct engagement with those spacing portions—during the mounting of that indicia adjacent, as well as the separating of that indicia from, that signboard. Also, the fact that the generally U-shaped confining portions 28 of the clips 24, 52 and 54 engage the flange 22 rather than the planar portion of indicia 20 facilitates the movement of the installer's fingers into direct engagement with the spacing portions 46 of those clips during the mounting of that indicia adjacent, as well as the separating of that indicia from, the signboard 10.

In disposing an indicia in the form of the letter "I" adjacent the signboard 10, only two clips would be used—one at the bottom of that indicia, and another at the top of that indicia. In disposing an indicia in the form of the letter "M" adjacent the signboard 10, four clips would be used—two adjacent the tops of the vertically-directed portions of that indicia, and two adjacent the bottoms of those vertically-directed portions.

The forwardly-bent abutments 34 and 38, respectively, on the fingers 32 and 36 will act as inclined planes whenever an installer urges an edge of flange 22 into the position shown by FIG. 2. Similarly, the outwardly-bent free edge 30 of the generally U-shaped confining portion 28 of finger 26 will act as an inclined plane whenever an installer urges an edge of flange 22 into the position shown by FIG. 2. As a result, the fingers 26, 32 and 36 can be made quite stiff—so they can apply substantial gripping forces to the flange 22—and yet be readily assembled with an edge of that flange.

It will be noted that the clips 24, 52 and 54 coact to apply upwardly-directed forces to the section 11 and downwardly-directed forces to the section 13 of the signboard 10. Those sections, and the other sections of that signboard, will be confined by a frame, not shown, of standard and usual design. As a result, the forces which the clips 24, 52 and 54 apply to the sections 11 and 13 will not be able to cause those sections to separate and, instead, will tend to urge the sections 11 and 13 into even more intimate engagement with the adjacent sections of the signboard 10 or with the frame for that signboard.

The indicia 20 preferably are seven and one-half ($7\frac{1}{2}$) inches tall or five and one-half ($5\frac{1}{2}$) inches tall. Indicia of that height are light in weight but are readily recognized when mounted forwardly of a signboard. The clips 24, 52 and 54 can be used with indicia of either size; and they will hold that indicia forwardly of that signboard a distance of about twenty-three thirty-seconds (23/32) of an inch.

The bend 48 can be made larger or smaller as desired, but it will always be an obtuse angle. Each of the bends 31, 35 and 40 can be made larger or smaller as desired, but it will always be an obtuse angle. The bend 44 can be made larger or smaller as desired, but it will always be an acute angle.

The board-engaging portion 40 of each clip 24, 52 or 54 is generally parallel to the spacing portion 42 of that clip. As a result, the reaction forces which the signboard 10 applies to the board-engaging portion 50 of those clips will be generally parallel to the spacing portion 42 of those clips, and hence will continuously urge the generally U-shaped confining portions 28 of those clips into intimate engagement with the adjacent portions of the edge of flange 22. Consequently, the signboard 10 helps hold the clips in engagement with the indicia 20.

The clips 24, 52 and 54 can roughly "nest" with each other and with other clips. As a result, the clips which are provided by the present invention can be packed, shipped and stored in a relatively small space.

Whereas the drawing and accompanying description have shown and described a preferred embodiment of the present invention, it should be apparent to those skilled in the art that various changes may be made in the form of the invention without affecting the scope thereof.

What I claim is:

1. A clip which can grip indicia and which can engage a signboard to dispose said indicia a short distance forwardly of said signboard and which comprises an elongated member of resilient material that has a board-engaging portion adjacent one end thereof, a plurality of fingers at the other end thereof, and an intermediate spacing portion, said clip being adapted to be disposed adjacent the rear of said indicia, one of said fingers having a portion thereof which is adapted to extend from a position adjacent the rear of said indicia past the adjacent edge of said indicia to a position adjacent the front of said indicia where it can overlie and engage a portion of said front of said indicia, another of said fingers being adapted to engage the rear of said indicia adjacent said edge of said indicia, said fingers acting, in their un-stressed state, to resist movement of said edge of said indicia into a position wherein said other finger can engage said rear of said indicia adjacent said edge of said indicia while said portion of said one finger overlies and engages said portion of said front of said indicia, said clip yielding in response to the application of stress thereto to permit relative movement between said one and said other fingers which will allow said edge of said indicia to move into said position wherein said other finger can engage said rear of said indicia adjacent said edge of said indicia while said portion of said one finger overlies and engages said portion of said front of said indicia, the relative movement of said one and said other fingers in response to said stress developing restorative forces within said clip which will cause said one and said other fingers to be urged into intimate gripping engagement with said rear of said indicia adjacent said edge of said indicia and into intimate gripping engagement with said portion of said front of said indicia.

2. A clip as claimed in claim 1 wherein said portion of said one finger is generally U-shaped and has an outwardly-bent free edge.

3. A clip as claimed in claim 1 wherein said clip has a third finger at said other end thereof, wherein said third finger is adapted to engage said rear of said indicia adjacent said edge of said indicia, whenever said edge of said indicia is in said position wherein said other finger can engage said rear of said indicia adjacent said edge of said indicia while said portion of said one finger overlies and engages said portion of said front of said indicia, wherein said third finger acts, in its un-stressed state, to resist movement of said edge of said indicia into said position wherein said other finger can engage said rear of said indicia adjacent said edge of said indicia while said portion of said one finger overlies and engages said portion of said front of said indicia, and wherein said other finger and said third finger are oppositely disposed of said one finger.

4. A clip as claimed in claim 1 wherein said one and said other fingers have forwardly-projecting portions which act as inclined planes when said edge of said clip is moved into said position wherein said other finger can engage said rear of said indicia adjacent said edge of said indicia while said portion of said one finger overlies and engages said portion of said front of said indicia.

5. A clip as claimed in claim 1 wherein said intermediate portion of said clip has a bend therein which engages the rear of said indicia at a point which is spaced inwardly from said edge of said indicia whenever said clip is in said position wherein said other finger can engage said rear of said indicia adjacent said edge of said indicia while said portion of said one finger overlies and engages said portion of said front of said indicia.

6. A clip as claimed in claim 1 wherein said one and said other fingers have bends intermediate the ends thereof, and wherein said bends are generally in register with each other.

7. A clip as claimed in claim 1 wherein said one and said other fingers have bends intermediate the ends thereof, and wherein the bend in said one finger is different from the bend in said other finger, whereby the end of said one finger is displaced from the end of said other finger.

8. A clip as claimed in claim 1 wherein said board-engaging portion applies a force to said intermediate portion of said clip, whenever said clip holds said indicia said short distance forwardly of said signboard, which enables said intermediate portion to apply a force to said one and said other fingers which tends to pull said portion of said one finger into intimate engagement with said edge of said indicia.

9. A clip as claimed in claim 1 wherein said intermediate portion of said clip has a bend therein which engages the rear of said indicia at a point which is spaced inwardly from said edge of said indicia whenever said clip is in said position wherein said other finger can engage said rear of said indicia adjacent said edge of said indicia while said portion of said one finger overlies and engages said portion of said front of said indicia, and wherein said bend acts as a fulcrum whenever said clip holds said indicia said short distance forwardly of said signboard.

10. A clip as claimed in claim 1 wherein the only part of said clip which is visible from the front of said signboard, whenever said clip holds said indicia said short distance forwardly of said signboard, is said portion of said one finger.

11. A clip as claimed in claim 1 wherein said board-engaging portion is generally parallel to said one end of said clip, whereby forces which are applied to said board-engaging portion in a direction that is generally parallel to said board-engaging portion will enable said intermediate portion of said clip to apply forces to said one end of said clip which are generally parallel to said one end of said clip.

12. A clip as claimed in claim 1 wherein said intermediate portion of said clip has a bend therein which engages the rear of said indicia at a point which is spaced inwardly from said edge of said indicia whenever said clip is in said position wherein said other finger can engage said rear of said indicia adjacent said edge of said indicia while said portion of said one finger overlies and engages said portion of said front of said indicia, wherein said one and said other fingers have bends intermediate the ends thereof, and wherein said bends in said one and said other fingers are spaced rearwardly of said rear of said indicia whenever said clip holds said indicia said short distance forwardly of said signboard.

13. A clip which can grip the peripheral flange of a flange-equipped indicia and which can engage a signboard to dispose said flange-equipped indicia a short distance forwardly of said signboard and which comprises an elongated member of resilient material that has a board-engaging portion adjacent one end thereof, a plurality of fingers at the other end thereof, and an intermediate spacing portion, said clip being adapted to be disposed adjacent the rear of said flange-equipped indicia, one of said fingers having a portion thereof which is adapted to extend from a position adjacent the rear of said flange-equipped indicia past the adjacent edge of said peripheral flange of said indicia to a position adjacent the front of said peripheral flange of said indicia where it can overlie and engage a portion of said front of said peripheral flange of said indicia, another of said fingers being adapted to engage the rear of said peripheral flange of said indicia adjacent said edge of said peripheral flange of said indicia, said fingers acting, in their un-stressed state, to resist movement of said edge of said peripheral flange of said indicia into a position wherein said other finger can engage said rear of said peripheral flange of said indicia adjacent said edge of said peripheral flange of said indicia while said portion of said one finger overlies and engages said portion of said front of said peripheral flange of said indicia, said clip yielding in response to the application of stress thereto to permit relative movement between said one and said other fingers which will allow said edge of said peripheral flange of said indicia to move into said position wherein said other finger can engage said rear of said peripheral flange of said indicia adjacent said edge of said peripheral flange of said indicia while said portion of said one finger overlies and engages said portion of said front of said peripheral flange of said indicia, the relative movement of said one and said other fingers in response to said stress developing restorative forces within said clip which will cause said one and said other fingers to be urged into intimate gripping engagement with said rear of said peripheral flange of said indicia adjacent said edge of said peripheral flange of said indicia and into intimate gripping engagement with said portion of said front of said peripheral flange of said indicia.

14. A clip as claimed in claim 13 wherein said intermediate portion of said clip has a bend therein which engages the rear of said indicia at a point which is spaced inwardly from said peripheral flange of said indicia whenever said clip is in said position wherein said other finger can engage said rear of said peripheral flange of said indicia adjacent said edge of said peripheral flange of said indicia while said portion of said one finger overlies and engages said portion of said front of said peripheral flange of said indicia.

15. A clip as claimed in claim 13 wherein said one and said other fingers have bends intermediate the ends thereof, and wherein said bends are different from the bend between said peripheral flange of said indicia and the adjacent portion of said flange-equipped indicia.

16. A clip as claimed in claim 13 wherein said one and said other fingers have bends intermediate the ends thereof, and wherein said edge of said peripheral flange of said indicia holds said bends in said one and said other fingers spaced rearwardly of a confronting portion of said rear of said flange-equipped indicia.

17. A clip as claimed in claim 13 wherein said edge of said peripheral flange of said indicia holds said portion of said one finger rearwardly of said rear of said flange-equipped indicia.

* * * * *